United States Patent [19]

Braun et al.

[11] 4,184,315

[45] Jan. 22, 1980

[54] APPARATUS FOR SUPPLYING COMPRESSED AIR IN ARRESTING THE ROTOR OF AN OPEN END SPINNING DEVICE

[75] Inventors: Erwin Braun; Erich Bock, both of Ingolstadt, Fed. Rep. of Germany

[73] Assignee: Schubert & Salzer, Ingolstadt, Fed. Rep. of Germany

[21] Appl. No.: 878,655

[22] Filed: Feb. 16, 1978

[51] Int. Cl.[2] ..... D01H 7/22; D01H 1/24

[52] U.S. Cl. ..... 57/89; 57/105

[58] Field of Search ..... 57/58.89–58.95, 57/88, 89, 104, 105, 78

[56] References Cited

U.S. PATENT DOCUMENTS

| | | | |
|---|---|---|---|
| 3,543,500 | 12/1970 | Bancroft et al. | 57/89 X |
| 3,603,068 | 9/1971 | Iida et al. | 57/104 |
| 3,805,506 | 4/1974 | Stahlecker | 57/78 |
| 4,070,814 | 1/1978 | Goldammer et al. | 57/105 X |

*Primary Examiner*—John Petrakes

*Attorney, Agent, or Firm*—Bailey, Dority & Flint

[57] ABSTRACT

An apparatus for bringing to rest the rotor of an open-end spinning apparatus which is covered by a cover. The rotor is mounted in a wedge gap formed by freely rotatably support rollers and pressed against the support rollers and driven by a tangential belt. An axial force arising from the support rollers presses the rotor against an axial stop. A lever is provided for lifting the shaft off of the support rollers and against stops for arresting the rotation of the rotor. Compressed air is applied to the rotor when the rotor is being brought to rest for maintaining the shaft of the rotor against the axial stop.

4 Claims, 5 Drawing Figures

4
7
43
46

47
41
44
42
1
6
50
11
12
51
62
45
10
65'
63
61
64'
2
30
3
40
20
71
92
9
91
95
93
94

43
6
10
7
62
63
41
64'
61
65'
60
71

30
3
40

APPARATUS FOR SUPPLYING COMPRESSED AIR IN ARRESTING THE ROTOR OF AN OPEN END SPINNING DEVICE

BACKGROUND OF THE INVENTION

The present invention relates to an apparatus for bringing to rest the rotor of an open-end spinning device, the shaft of which is mounted in a tapered gap formed by freely rotatable supporting rollers and is pressed against the support rollers and driven by a tangential belt, as disclosed in West German Auslegeschrift No. 2,525,435.

This known apparatus has a lever which is pivotable about an axis and which has a belt-lifter roller and a support that receives the shaft. On movement of the lever towards the tangential belt, the belt is lifted from the shaft by the belt-lifter roller, and then the shaft is moved by the support away from the support rollers and is pressed against stops constructed as support bearings. A reliable bringing to rest of the rotor, with little wear is ensured since the drive process is precisely separated from the braking process and the influence of the inertial masses of the support rollers on the rotor is excluded. Here the axial securement of the rotor shaft can be effected by a gearwheel which engages in a recess of the rotor shaft or by an axial force acting on the rotor shaft with the rotor shaft supported by its free end on a thrust bearing.

However, to the extent that the axial force arises from the support rollers, an accurate securement of the rotor and of the rotor shaft is not provided at the moment when, during braking, the rotor shaft is lifted from the support pulleys. Unwanted displacements of the rotor in the axial direction can occur.

SUMMARY OF THE INVENTION

The problem of axial fixation of the rotor is solved according to the invention by utilizing a stream of compressed air directed against an inner wall of the rotor for axially forcing the rotor shaft against the axial stop during the time that the rotor is being brought to rest. As previously mentioned, it is conventional to bring the rotor to rest by manipulating a lever which lifts the shaft of the rotor off of the support rollers and out of engagement with the tangential belt and also into an engagement with stops. The air nozzle is carried in the cover which may be a conventional cover for the rotor of an open-end spinning machine and a feed duck connects a source of compressed air to the air nozzle. A valve means is interposed in the feed duck and is actuated when the lever is lifting the shaft of the rotor off of the support rollers compressing the rotor shaft against an axial stop when the rotor is being brought to rest.

In one particular embodiment, the actuator is operably connected to the lever for opening the valve when the lever is manipulated to bring the rotor to a rest.

In another particular embodiment, the actuator for the valve means is operably connected to the cover for being opened when the cover is open.

In one embodiment the actuator for the valve means is connected to a pivotably mounted lever that is carried by the cover for opening the valve when the pivotably mounted lever is moved from a first position to a second position. The pivotably mounted lever has a cam surface thereon which engages the lever for initiating bringing the rotor to rest when the pivotably mounted lever is moved from the first position to a second position. The pivotably mounted lever can be moved from the first position to the second position while the cover is closed, thus the rotor can be brought to rest while the cover is closed and during this period, compressed air is fed through the nozzle striking the inner wall of the rotor forcing the shaft against an axial stop.

Accordingly, it is an object of the present invention to utilize a stream of compressed air for forcing the shaft of a rotor of an open-end spinning device against an axial stop when the rotor is being brought to rest.

Still another important object of the present invention is to provide an apparatus for bringing to rest the rotor of an open-end spinning machine and applying an axial force against the rotor for forcing the shaft valve against an axial stop while the cover for the rotor is closed.

These and other objects and advantages of the invention will become apparent upon reference to the following specification, attendant claims, and drawing.

DESCRIPTION OF A PREFERRED EMBODIMENT

Figure 1:
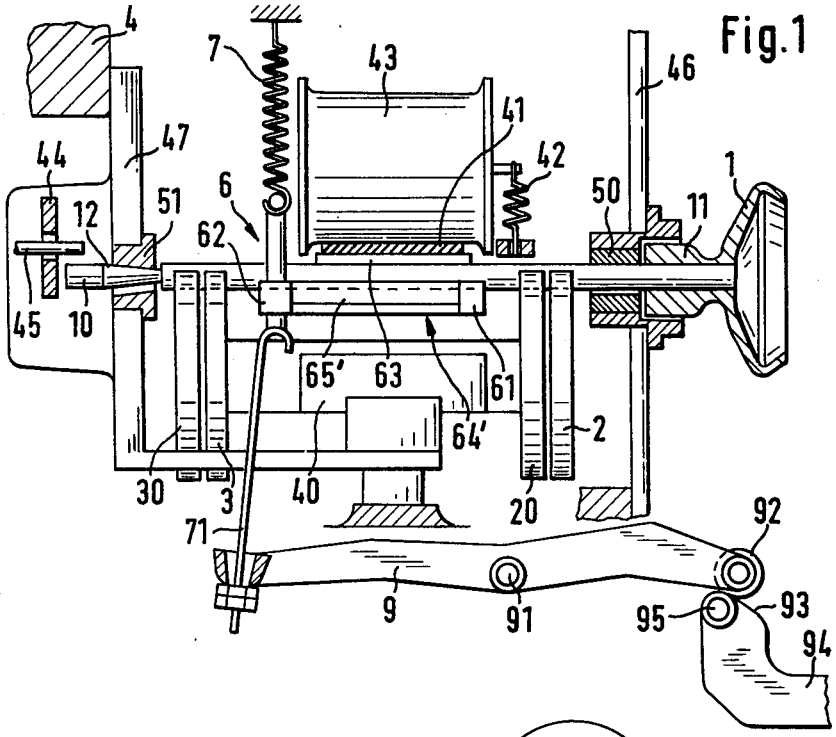
FIG. 1 shows a side view of the stopping device with conically constructed rotor shaft and stop.
Figure 2:
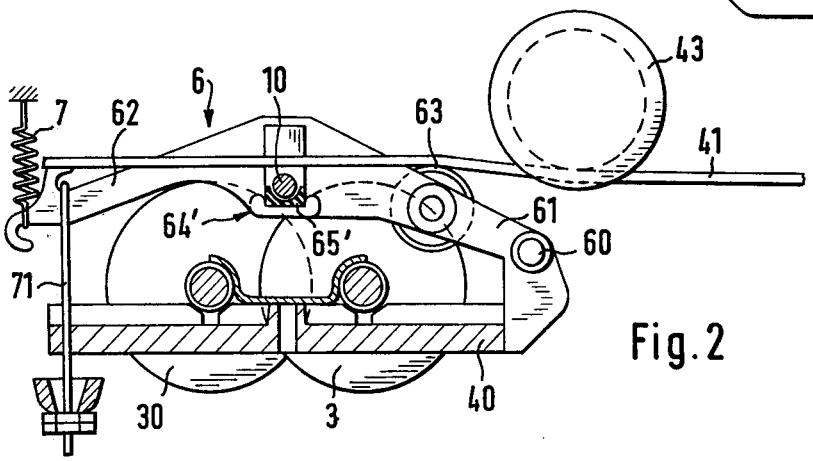
FIG. 2 shows a front sectional view of the device according to FIG. 1 with unimportant parts omitted.

The horizontally-arranged shaft 10 of a spinning assembly of an open-end spinning apparatus carries a rotor 1 with a collar 11 and is mounted in the tapered gap formed by the roller pairs 2, 20 and 3, 30, which are attached to a mounting block 40. A tangential belt 41 drives the shaft 10 and the rotor 1 attached to it. The tangential belt 41 is pressed against the shaft 10 by a tensioning roller 43 which is under the pressure of a spring 42, so that the shaft 10, when running, is pressed against the support rollers 2, 20 and 3, 30 and is located in the radial direction. The axial securement of the shaft 10 while running is effected by an axial stop 44 in the form of a washer which is rotatably mounted on a stationary shaft 45 and against which the shaft 10 is pressed with its free end by an axial force exerted by the support rollers.

Two stops 50 and 51, constructed as support bearings, are associated with the shaft 10 and are conveniently each arranged in a respective bore of a stationary mounting plate 47 and a wall 46 which forms the back wall of the spinning chamber receiving rotor 1 and together with a housing part 4 (only a portion shown) encloses the whole mounting. Preferably, the stops 50 and 51 annularly surround the shaft and are constructed as slide bearings. Their internal diameter corresponds to the diameter of the shaft 10 together with a length of twice the permissible disengagement path over which the shaft 10 passes when the spinning assembly is brought to rest.

A stationary shaft 60 is arranged beneath the tangential belt 41 and substantially perpendicular to the direction in which it runs, and near to the tensioning roller 43. A lever 6 with arms 61 and 62 is pivotably mounted on the shaft 60, and is movable from a position of readiness in the direction towards the tangential belt 41, into a disengagement or stopping position. The arms 61 and 62 carry a roller 63 to lift the tangential belt 41 from the shaft 10 and also provides a support for the shaft 10.

A tension spring 7 which engages the free end of the arm 62 tends to urge the lever 6 from its readiness position in the direction towards the tangential belt 41. The lever 6 is held in the readiness position by means of a pull rod 71, which likewise engages the free end of the arm 62 and is connected to a two-armed lever 9 which is pivotable about a shaft 91. The two-armed lever is thus arrested in such a position that it exerts on the lever via the pull rod 71 a tension force which opposes and exceeds the force of the spring 7. Preferably, the arrest of the lever 9 is effected by means of the spinning chamber housing cover 94, which is pivotable about a shaft 95 and on the curved part 93 which abuts a roller 92 of the lever 9.

Over and above this known arrangement, the shaft 10 has, in the neighborhood of the stop 51, a section 12 which tapers conically against its direction of axial support (FIG. 1). The adjunction of this conical section 12 to the stop 51 lying adjacent to the free end of the shaft 10 in the present embodiment does not, however, exclude the possibility of instead making the shaft 10 conical, in the manner shown, in the neighborhood of the stop 50, or also in the region of both stops 50 and 51. The conical structure of the shaft only in the region of one of the stops formed as support mountings has been found to be in itself sufficient. As can be gathered from FIG. 1, the inner wall of the stop 51 also possesses a conicity corresponding to the conical shaft section 12. The feature mentioned above, that the internal diameter of the stop 51 at each point of its conical inner wall corresponds to the respective diameter of the shaft 10 or section 12 together with twice the disengagement path of the shaft, however remains unaffected by this.

Apart from this, the conicity of the shaft section 12 and stop 51 is preferably dimensioned such that the minimal internal diameter of the stop 51 is at least equal to the diameter of the cylindrical part of the shaft 10 adjoining the conical section 12. In this way it is insured that the cylindrical part of the shaft 10 can also pass the stop 51 when it has to be pulled out from its mounting with the shaft 10 when changing the rotor 1.

When the arrest of the lever 9 is released, the spring moves the lever 6 in the direction towards the tangential belt 41, so that the roller 63 lifts the tangential belt 41 from the shaft 10 and also the shaft 10 is lifted, by means of the stop 64 on which a brake lining 65 is appropriately arranged, from the wedge gap of the support rollers 2, 20 and 3, 30, and is pressed against the stops 50 and 51, which are constructed as sliding bearings. An axial force is produced by the mutual action of the conical section 12 of the shaft 10 and the conical wall of the stop 51, and ensures the axial securement of the shaft 10 during stopping.

Figure 3:
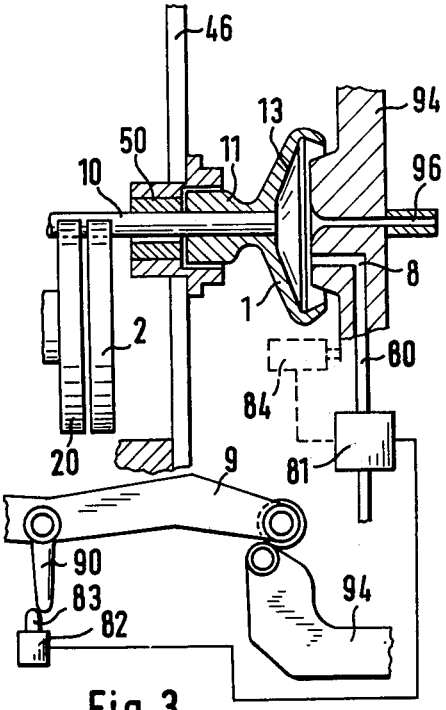
FIG. 3 shows a side view of an apparatus constructed in accordance with the present invention for pneumatic fixation of the rotor shaft during stopping.
Figure 4:
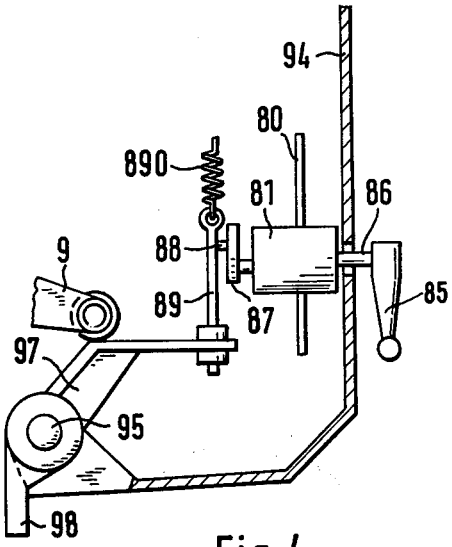
FIGS. 4 and 5 show modifications of the device shown in FIG. 3 in side view.
Figure 5:
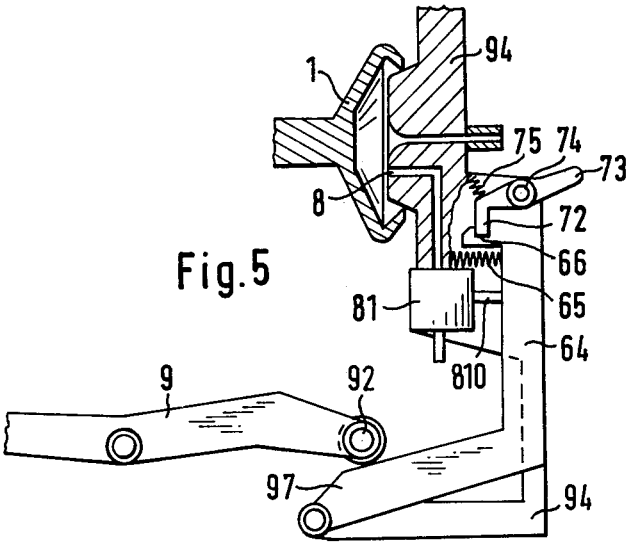

Instead of the conical design of a shaft section and of at least one of the stops which are constructed as support mountings as described, or in addition thereto, the axial securement of the rotor shaft during stopping can also be brought about according to the present invention by means of compressed air as shown in FIGS. 3 through 5.

For this purpose, there is arranged in the cover 94 in addition to the (not shown) yarn feed tube and to the yarn takeoff tube 96, a compressed air nozzle 8 which is directed against an inner wall 13 of the rotor 1 (FIG. 3). The compressed air nozzle 8 is supplied with compressed air via a feed duct 80 in which there is arranged a valve 81.

A means for opening the valve 81 includes a thread arm 90 on lever 9 which is constructed as a change cam for an actuator in the form of a switch 82 which is connected for control to the valve 81 so that the feed duct 80 for the compressed air nozzle 8 is controlled in dependence on the actuation of the lever 9.

When the rotor shaft 10 is lifted in the manner described above from the wedge gap of the support rollers 2, 20 and 3, 30 during the braking process, as the lever 9 pivots, its arm 90 comes into contact with the change pin or change cam 83 which is pressed down and actuates the switch 82. This, in its turn, actuates the valve 81, releasing the supply of compressed air to the compressed air nozzle 8. In this way, compressed air is blown against the inner wall 13 of the rotor 1, so that the rotor shaft 10 is held in abutment against the axial stop 44 (FIG. 1). In this way, the rotor shaft 10, and hence the rotor 1, is axially secured.

Furthermore, the cover 94 can also be connected, as well as to the lever 9 in a control mode to the valve 81 so that after a given degree of opening of the cover 94, the feed of compressed air to the compressed air nozzle is interrupted again. For this purpose, the cover 94 can have adjoined to it an actuator in the form of a switch 84 (shown dashed in FIG. 3) which is released after a given amount of pivoting of the cover 94.

FIG. 4 shows an embodiment which enables the rotor shaft to be brought to rest and the axial position of the rotor shaft to be pneumatically secured during bringing to rest, also when the cover is closed. The cover 94 is once more pivotably mounted on a shaft 95 on which a change cam 97 is pivotably arranged. The change cam 97 has a nose 98 by means of which the cover 94, when pivoted, can entrain the change cam 97.

The valve 81 which controls the feed duct 80 is mounted in the cover 94. The valve 81 is controlled by a handle 85 on shaft 86 of which is seated an eccentric disk 87. A nose 88 of a pull bolt 89 engages in an annular slot (not shown) in this eccentric disk 87 and is acted on by a spring 890 by which the change cam 97 is held with its nose 98 in abutment on the cover 94.

To bring to rest and axially secure the rotor shaft 10 with the rotor 1 without opening the cover 94, the valve 81 is actuated by turning the handle 85 and compressed air is fed to the compressed air nozzle 8 (FIG. 3) so that the rotor 1 is pneumatically secured in the axial direction. Simultaneously with the pivoting of the handle 85, the eccentric disk 87 is also pivoted downwards whereby the pull bolt 87 is pushed downwards against the action of the spring 890 so that the change cam 97 is pivoted and its nose is lifted from the cover 94. The lever 9 is thus actuated in the same way as when the cover 94 is opened, and bringing to rest of the apparatus is thus effected in the manner already described. The feed of compressed air to the compressed air nozzle is interrupted at the desired moment by turning the handle back so that the rotor 1 also returns to its operation position.

For a more compact design, the embodiment shown in FIG. 5 has the change cam 97 as a component of a pivot lever 64 which is arranged in a slot of the cover 94. The lever 64 is acted on by a compression spring 65 which is supported on the cover 94 and presses the lever 64 into the braking position. In the braking position, the change cam 97 releases the roller 92 of the lever 9 so that the rotor shaft 10 is lifted out of the wedge gap of the support rollers 2, 20 and 3,30. The lever 64 has a recess 66 in which engages, in the operator position, a notch nose 72 of a release lever 73.

The release lever 73 is pivotably mounted by a bolt 74 in the cover 94 and is acted on by a compression spring which is supported on the cover 94 and which holds the notch nose 72 in engagement with the recess 66. The pivot lever 64 can thus be locked to the cover 94 so that it has to move with it, or it can be released from the cover 94 and then be movable relative to it.

The valve 81 is also arranged in the cover 94 in this embodiment and is controlled by a change pin 810 which is normally actuated by the pivot lever 64, but is released by a relative motion from a first position to a second position of the pivot lever 64 and the cover 94.

If the rotor has to be braked without opening the cover 94, solely the release lever 73 is actuated, and its notch nose 72 releases the pivot lever 64. The preloaded compression spring 65 brings the pivot lever 64 into the braking position so that its change cam 97 releases the roller 92 of the lever 9 and the rotor is braked. Simultaneously or shortly beforehand, the pivot lever 64 releases the change pin 810 so that the valve 81 releases the supply of compressed air from a suitable source of compressed air to the compressed air nozzle 8. The compression 65 can in some circumstances also be omitted, since the tension spring 7 (FIG. 1) also acts on the pivot lever 64 via the pull rod 71, the lever 9 and the cam 97.

While a preferred embodiment of the invention has been described using specific terms, such description is for illustrative purposes only, and it is to be understood that changes and variations may be made without departing from the spirit or scope of the following claims.

What is claimed is:

1. Apparatus for bringing to rest a rotor of an open-end spinning apparatus, a cover extending over said rotor, said rotor having an inner wall and a shaft, a wedge gap formed by freely rotatable support rollers, said shaft being carried in said wedge gap, an axial stop, a tangential belt driving said shaft and pressing said shaft against said support rollers wherein an axial force arising from the support rollers presses said rotor shaft against said axial stop, a movable lever for initiating the bringing to rest of said rotor, a plurality of stops constructed as support mountings, and means for moving said shaft away from said support rollers into contact with said stops for stopping the rotation of said shaft, the improvement comprising:

a source of compressed air;

an air nozzle carried in said cover and being directed towards said inner wall of said rotor;

a feed duct connecting said source of compressed air to said air nozzle;

a valve means interposed in said feed duct; and means for opening said valve means allowing compressed air to be fed through said nozzle striking said inner wall of said rotor forcing said shaft against said axial stop when said lever is initiated to bring said rotor to rest.

2. The apparatus for bringing to rest the rotor as set forth in claim 1 wherein said means for opening said valve comprises:

an actuator operably connected to said lever for opening said valve when said lever is initiated to bring said rotor to rest.

3. The apparatus as set forth in claim 1 wherein said means for opening said valve comprises:

an actuator operably connected to said cover for opening said valve when said cover is opened.

4. The apparatus as set forth in claim 1 for bringing to rest the rotor wherein said means for opening said valve comprises:

a pivotally mounted lever carried by said cover;

said valve means being carried by said cover;

an actuator operably connected to said pivotally mounted lever for opening said valve when said pivotally mounted lever is moved from a first position to a second position; and a cam surface carried by said pivotally mounted lever for engaging said lever for initiating bringing said rotor to rest when said pivotally mounted lever is moved from said first position to said second position;

whereby when said pivotally mounted lever is moved from a first position to a second position, said rotor is brought to rest and compressed air is fed through said nozzle striking said inner wall of said rotor forcing said shaft against said axial stop.

* * * * *